US006235443B1

(12) United States Patent
Kayamoto et al.

(10) Patent No.: US 6,235,443 B1
(45) Date of Patent: May 22, 2001

(54) CARRIER FOR ELECTROPHOTOGRAPHIC DEVELOPER AND ELECTROPHOTOGRAPHIC DEVELOPER CONTAINING THE SAME

(75) Inventors: Kanao Kayamoto; Kazunori Takagi; Yuji Sato, all of Chiba-ken (JP)

(73) Assignee: Powdertech Co., Ltd., Chiba-ken (JP)

( * ) Notice: Subject to any disclaimer, the term of this patent is extended or adjusted under 35 U.S.C. 154(b) by 0 days.

(21) Appl. No.: 09/479,000

(22) Filed: Jan. 7, 2000

(30) Foreign Application Priority Data

Feb. 18, 1999 (JP) ..... 11-039980

(51) Int. Cl.[7] ..... G03G 9/113
(52) U.S. Cl. ..... 430/108; 430/106.6
(58) Field of Search ..... 430/106.6, 108

(56) References Cited

U.S. PATENT DOCUMENTS

| | | | | |
|---|---|---|---|---|
| 5,482,806 | | 1/1996 | Suzuki et al. | 430/106.6 |
| 5,731,120 | * | 3/1998 | Tanigami et al. | 430/106.6 |
| 6,124,066 | * | 9/2000 | Kim et al. | 430/106.6 |

FOREIGN PATENT DOCUMENTS

| | | | | |
|---|---|---|---|---|
| 58-108549 | * | 6/1983 | (JP) | 430/108 |
| 5-204189 | * | 8/1993 | (JP) | 430/108 |
| 7-140723 | | 6/1995 | (JP) . | |
| 8-179570 | | 7/1996 | (JP) . | |
| 8-286429 | | 11/1996 | (JP) . | |

OTHER PUBLICATIONS

Grant, R. et al., ed. Grant & Hackh's Chemical Dictionary, 5th ed, McGraw–Hill Book Co. NY. (1987), p. 445.*

Derwent Abstract AN 1988–082005 of Japanese Patent 01035561 (Pub Feb. 6, 1989).

Patent Abstract of Japan, vol. 13, No. 342 (Aug. 2, 1989) of JP 0110560 (Pub 4/89).

Patent Abstract of Japan, vol. 12, No. 165 (May 18, 1988) of JP 62 275186 (Pub 11/87).

* cited by examiner

*Primary Examiner*—Janis L. Dote
(74) *Attorney, Agent, or Firm*—Young & Thompson

(57) ABSTRACT

A carrier for an electrophotographic developer which is coated with an insulating resin containing a white conducting agent, wherein the white conducting agent includes spherical to lumpy particles of $TiO_2$ $ZnO_2$ or $SnO_2$ having two or more average particle sizes, the particles having thereon a 5 to 50 Å thick conducting layer of $SnO_2$ having a group V metal or phosphorus in solid solution therein.

8 Claims, No Drawings

CARRIER FOR ELECTROPHOTOGRAPHIC DEVELOPER AND ELECTROPHOTOGRAPHIC DEVELOPER CONTAINING THE SAME

BACKGROUND OF THE INVENTION

1. Field of the Invention

The present invention relates to a carrier for an electrophotographic two-component developer used in copying or printing machines and a developer containing the carrier. More particularly, it relates to a carrier which is particularly suitable for use in color developers, does not cause deterioration of image quality, such as color mixing, reduction of image density, edge effect, and the like, has reduced environmental dependence, and exhibits high durability and to a developer containing the carrier.

2. Description of the Related Art

It has been proposed to coat carrier particles for two-component developers with various resins so as to give a carrier improved durability against a toner-spent phenomenon.

However, a resin coat increases the resistance of a carrier, causing deterioration of image quality, specifically, reduction in image density, edge effect, and the like. The carrier resistance should be optimized by manipulating the machine system or controlling the development conditions. There are many reports on addition of a conductive substance (conducting agent) to the resin coating layer so as to adjust the carrier resistance. Various kinds of carbon black are widely known as a general-purpose conductive substance for its competitive price and ease in controlling resistance.

Addition of carbon black to the resin coating to control the resistance of a resin-coated carrier is successful in preventing image density reduction or an edge effect. However, where applied to color toners particularly of light color (e.g., yellow), carbon black is mixed into toner particles to cause contamination (color mixing).

In order to overcome the problem of color mixing which arises from use of carbon black for resistance control, the following proposals have been made to date. Japanese Patent Laid-Open No. 286429/96 discloses a double-coated carrier having two resin coating layers, the inner layer containing conductive carbon, while the outer layer containing a white conducting agent. Japanese Patent Laid-Open No. 140723/95 proposes a resin-coated carrier having a conducting agent uniformly dispersed on the surface of the carrier core but not in the resin layer. Japanese Patent Laid-Open No. 179570/96 teaches a resin-coated carrier for full color development, the resin coating layer of which contains carbon black in a concentration gradually decreasing toward the surface, falling to zero on the surface.

However, after long-term use, the coating layer of these proposed resin-coated carriers is scraped off to cause color mixing. That is, as long as carbon black is used, none of the prior arts provides a radical solution to the outstanding problems.

With regard to environmental dependence, carriers containing carbon black is heavily dependent on the environment on account of the low resistance of carbon black per se. Cases are often met with, in which charges leak particularly in a high temperature and high humidity condition, and an appreciable discharge takes place upon switching on the machine. At the beginning of operation, therefore, background staining tends to occur, and the rise of charging performance is poor, resulting in a failure to obtain a clear image.

On the other hand, a resin-coated carrier whose resin coating layer contains only inorganic oxides as a conducting agent is disclosed in Japanese Patent Laid-Open No. 35561/89, in which the resin coating layer contains at least one inorganic oxide selected from titanium oxide, zinc oxide, and tin oxide. Having high resistance per se, the inorganic oxide must be added to the resin in a much larger amount than carbon black so as to adjust the resistance at a desired level, which will reduce the durability of the resin coating layer.

With the increasing demand for high image quality, toner particles have been being reduced in size. Hence, recent studies have been directed to use in a high charge quantity area. As for a carrier core, the demands for high image quality and long-term durability have replaced high magnetic core materials such as iron powder with low magnetic core materials such as ferrite, which has higher resistance than the former. It follows that the conventional techniques have now come to be inadequate, seeing the problem that the developer has so high resistance as to reduce the image density or cause an edge effect, resulting in a failure to obtain desired image quality or a desired developer life. If a conductive substance is added in an increased amount to optimize the resistance, the coating resin will have reduced strength, which also leads to reduction of the life.

SUMMARY OF THE INVENTION

An object of the present invention is to provide a carrier for an electrophotographic developer which does not cause deterioration of image quality, such as contamination of a color toner (color mixing), reduction of image density (caused by high resistance of a carrier), or an edge effect, and has reduced environmental dependence and improved durability and to provide a developer containing the carrier.

As a result of extensive investigations, the present inventors have found that the above object is accomplished by using two or more white conducting agents different in average particle size which comprise spherical to lumpy $TiO_2$, $ZnO_2$ or $SnO_2$ particles having on the surface thereof a given thickness of a conducting layer of $SnO_2$ having a group V metal or phosphorus in solid solution therein.

Based on this finding, the present invention provides a carrier for an electrophotographic developer which is coated with an insulating resin containing a white conducting agent, wherein the white conducting agent comprises two or more kinds of spherical to lumpy particles of $TiO_2$, $ZnO_2$ or $SnO_2$ different in average particle size, the particles having thereon a 5 to 50 Å thick conducting layer of $SnO_2$ having a group V metal or phosphorus in solid solution therin.

The present invention also provides an electrophotographic developer comprising the carrier and a toner.

The carrier for an electrophotographic developer and the developer comprising the same according to the present invention do not cause deterioration of image quality, such as contamination of a color toner (i.e., color mixing), reduction of image density (caused by high resistance of a carrier), or an edge effect, and has reduced environmental dependence and improved durability.

DETAILED DESCRIPTION OF THE INVENTION

The carrier of the present invention has its surface coated with an insulating resin containing a white conducting agent. The insulating resin which can be used includes polyolefin resins, such as polyethylene, polypropylene, chlorinated polyethylene, and chlorosulfonated polyethylene; polyvinyl or polyvinylidene resins, such as polystyrene, acrylic resins (e.g., polymethyl methacrylate), polyacrylonitrile, polyvinyl acetate, polyvinyl alcohol, polyvinyl butyral, polyvinyl chloride, polyvinyl carbazole, polyvinyl ether, and polyvinyl ketone; vinyl chloride-vinyl acetate copolymers; styrene-acrylic acid copolymers; silicone resins, such as a straight silicone resin composed of an organosiloxane bond, or modified resins thereof (e.g., alkyd-, polyester-, epoxy- or polyurethane-modified silicone resins); fluororesins, such as polytetrafluoroethylene, polyvinyl fluoride, polyvinylidene fluoride, and polychlorotrifluoroethylene; polyamide; polyester resins, such as polyethylene terephthalate; polyurethane; polycarbonate; amino resins, such as urea-formaldehyde resins; and epoxy resins.

Of these resins, preferred are acrylic resins, silicone resins or modified silicone resins, and fluororesins for their resistance against adhesion of spent toner particles thereto. Silicone resins and modified silicone resins are particularly preferred. Commercially available silicone or modified silicone resins can be made use of. For example, suitable silicone resins include KR-271, KR-255 and KR-251 (all produced by Shin-Etsu Chemical Co., Ltd.) and SR-2400, SR-2406, and SR-2411 (all produced by Toray-Dow Corning Silicone); and suitable modified silicone resins include KR-206 (alkyd-modified silicone resin), KR-9706 (acryl-modified silicone resin), KR-3093 (acryl-modified silicone resin), and ES-101N (epoxy-modified silicone resin) (all produced by Shin-Etsu Chemical) and SR-2115 (epoxy-modified silicone resin) and SR-2110 (alkyd-modified silicone resin) (both produced by Toray-Dow Corning Silicone).

The white conducting agent used in the invention is a mixture of two or more kinds of particles which are spherical to lumpy in shape, comprise $TiO_2$, $ZnO_2$ or $SnO_2$, and are different from each other in average particle size. Needle-like particles are unfavorable because they are easily broken when intensely dispersed in an insulating resin (coating resin), and the broken pieces show no electrical conductivity, failing to provide the carrier with satisfactory resistance. $TiO_2$ is the most preferred as a core material of the white conducting agent.

The white particulate conducting agent has on the surface thereof a conducting layer of $SnO_2$ having, a group V metal or phosphorus in solid solution therein. The group V metal includes antimony. Antimony is particularly preferred not only for its conductivity but for the performance in providing a developer with satisfactory charging properties and for its small environmental dependence. The amount of the group V metal or phosphorus to be solid dissolved is preferably in a range of from 5 to 35% by weight based on $SnO_2$.

The thickness of the conducting layer is 5 to 50 Å, preferably 15 to 40 A, still preferably 25 to 35 Å. With a thickness less than 5 Å, it is difficult for the coated carrier to have a desired resistance. A thickness exceeding 50 Å brings about no further effect on electrical conduction but bad economy and, besides, the conducting layer would wear considerably while dispersed.

For the sake of convenience of description, the white conducting agent having a smaller average particle size is taken as A, and that having a larger one as B. It is preferred that the average particle size of conducting agent A be from 0.01 to 0.08 $\mu$m, the average particle size of conducting agent B be from 0.1 to 0.5 $\mu$m, and the A/B weight ratio be from 10:90 to 90:10, particularly 25:75 to 75:25. Combining conductive powders having different sizes at a certain mixing ratio achieves the closest packing and makes it easy to obtain conductivity efficiently while minimizing the content of the white conducting agent. The average particle size of the white conducting agent can be measured conveniently with, for example, Microtrack UPA measuring device manufactored by Nikkiso.

Conducting agent A still preferably has an average particle size of 0.02 to 0.06 $\mu$m, a BET specific surface area of 25 to 40 $m^2/g$, and a DBP oil absorption of 25 to 40 ml/100 g. Conducting agent B still preferably has an average particle size of 0.1 to 0.4 $\mu$m, a BET specific surface area of 5 to 8 $m^2/g$, and a DBP oil absorption of 10 to 20 ml/100 g.

It is desirable for the white conducting agent to have a shape-surface index of 2.0 to 6.0. If the shape-surface index is out of this range, the shape of the particles are instable so that the white conducting agent tends to be broken, failing to obtain the conducting effect.

The terminology "shape-surface index" as used herein means a quotient of a specific surface area obtained by a BET method by a specific surface area obtained by an air permeation method, which can be a measure for controlling the shape and surface properties of the conducting agent. A BET method based on nitrogen gas displacement is fit for precise measurement of the surface area of individual particles, while an air permeation method is a method of measuring the specific surface area from the time required for air to pass through a layer of particles packed in a cell and rather gives a value correlated to the shape and size of the particles.

Accordingly, a shape-surface index can be calculated from the specific surface areas obtained by these methods according to the following formula:

Shape-surface index=[specific surface area by BET method ($m^2/g$)]/[specific surface area by air permeation method ($m^2/g$)]

The BET specific surface area is measured with, for example, a GEMINI 2360 measuring device; manufactured by Shimadzu Corp. or its equivalent, and the specific surface area by a air permeation method is measured with, for example, an SS-200 measuring device; manufactured by Shimadzu Corp. or its equivalent.

The white conducting agent can be prepared through various processes. For example, $TiO_2$ particles as a core of the white conducting agent is slurried and coated with Sb-containing $SnO_2$ which is obtained by neutralization and hydrolysis of an aqueous solution of tin chloride and antimony chloride. The coated $TiO_2$ particles are collected by filtration, washed, calcined and ground to obtain $TiO_2$ conducting agent coated with $SnO_2$ having Sb solid dissolved therein.

The white conducting agent is incorporated into an insulating resin in an amount preferably of 2 to 75% by weight, still preferably 5 to 60% by weight, and particularly preferably 15 to 50% by weight. If the white conducting agent content is less than 2% by weight, a sufficient effect on conductivity cannot be obtained. If it exceeds 75% by weight, the insulating resin layer has reduced strength, and the resulting resin-coated carrier and the developer will have reduced durability.

The white conducting agent is dispersed in the insulating resin by means of grinder with media like the PEARLMILL grinder manufactured by Ashizawa Co.,Ltd., and the DYNO-MILL grinder manufactured by Willy A.Bachofen AG, etc. A dispersing aid may be used for accelerating dispersion.

It is a preferred embodiment to add an aminosilane coupling agent to the insulating resin. Addition of an aminosilane coupling agent enhances the charging ability for toner particles, especially negatively chargeable toner particles, which is particularly effective in application to full color development involving more frequent contact between a carrier and a toner. A preferred content of the aminosilane coupling agent in the insulating resin is 1 to 35% by weight, particularly 5 to 35% by weight.

The aminosilane coupling agent to be added is not particularly limited in kind, and conventional widespread compounds represented by the following formula are used.

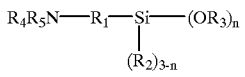

wherein $R_1$ represents an alkylene group having 1 to 4 carbon atoms or a phenylene group; $R_2$ and $R_3$ each represent an alkyl group having 1 or 2 carbon atoms; R4 and $R_5$ each represent a hydrogen atom, a methyl group, an ethyl group, a phenyl group, an aminomethyl group, an aminoethyl group or an aminophenyl group; and n is 2 or 3.

Particularly preferred of them are those having a primary amino group, being represented by the following formula, for their high ability of charging a toner.

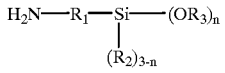

wherein $R_1$ represents an alkylene group having 1 to 4 carbon atoms; $R_2$ and $R_3$ each represent an alkyl group having 1 or 2 carbon atoms; and n is 2 or 3.

Conventionally known carriers can be used as a core material to be coated according to the present invention, such as iron powder, ferrite powder, and magnetite powder. Ferrite powder is preferred because it is easy to control the surface condition, shape, resistance, etc. of ferrite powder which are influential on the characteristics of the carrier after being coated. Mn—Mg—Sr ferrite is particularly preferred because (1) grain growth is uniformly controllable, (2) a smooth and uniform surface, which is advantageous to resin coating, can be obtained, (3) there is little variation of magnetization among particles, and (4) the carrier magnetization properties are excellent.

The carrier particles preferably have an average particle size of 25 to 100 $\mu$m and comprise small-diameter particles of 16 $\mu$m or less in a proportion of not more than 5.0% by weight. Carrier particles having an average particle size smaller than 25 $\mu$m and contain more than 5.0% by weight of small-diameter particles of 16 $\mu$m or less comprise a large proportion of fine particles of low magnetization per particle which tend to scatter during development. If the average particle size of the carrier particles exceeds 100 $\mu$m, the specific surface area decreases to reduce the ability of charging a toner.

The Mn—Mg—Sr ferrite is prepared as follows. Raw materials, such as metal oxides, metal carbonates and metal hydroxides, are mixed in an appropriate ratio and wet ground together with water in a wet ball mill or a wet vibration mill, etc. for 1 hour or longer, preferably 1 to 20 hours. The slurry is dried and granulated. In some cases, the raw materials are mixed, dry ground, and then granulated. The resulting granules are calcined at 700 to 1200° C. The calcination step may be omitted when reduction in apparent density is desired. The calcined particles are again ground in a wet ball mill or a wet vibration mill to an average particle size of 15 $\mu$m or smaller, preferably 5 $\mu$m or smaller, still preferably 2 $\mu$m or smaller. If desired, a dispersant, a binder, and the like are added to the resulting slurry. After viscosity adjustment, the slurry is granulated, and the powder is fired at 1000 to 1500° C. for 1 to 24 hours. The magnetization characteristics and resistance of the ferrite can be adjusted arbitrarily by controlling the firing atmosphere, i.e., the oxygen concentration of the atmosphere. The fired product is disintegrated and screened. Small-diameter carrier core particles having an average particle size of 60 $\mu$m or smaller are obtained by classifying with an air classifier, etc. If necessary, the resulting powder can be subjected to slight reduction followed by surface oxidation in low temperature.

The coating weight of the resin on the core is 0.03 to 5.0% by weight, preferably 0.05 to 2.0% by weight, based on the core. A coating weight less than 0.03% tends to fail to form a uniform coat on the carrier surface. A coating weight exceeding 5.0% forms a so thick resin coat that the coated carrier particles may agglomerate with each other, and it is difficult to obtain uniform carrier particles.

Coating of the carrier core with the resin is usually conducted by a wet process comprising applying the resin as diluted with a solvent onto the surface of the core by dipping, spraying, brushing, kneading or a like technique and volatilizing the solvent. A dry process comprising coating the core with a powdered resin is also effective.

After coating, the coating layer can be baked, if desired, either by external heating or internal heating by means of, for example, a fixed bed or fluidized bed electric oven, a rotary kiln type electric oven, a burner oven, or a microwave oven. The baking temperature preferably ranges from 150 to 300° C.

The resin-coated carrier according to the present invention is mixed with a toner to provide a two-component developer. The toner to be used comprises a binder resin having dispersed therein a colorant, a charge control agent, etc. Known black and color toners can be utilized.

While not limiting, the binder resin which can be used in the toner includes polystyrene, chloropolystyrene, a styrene-chlorostyrene copolymer, a styrene-acrylic ester copolymer, a styrene-methacrylic acid copolymer, a rosin-modified maleic acid resin, an epoxy resin, a polyester resin, a polyethylene resin, a polypropylene resin, and a polyurethane resin. These binder resins can bemused either individually or as a mixture thereoL To be combined with the carrier of the present invention, polyester-based color toners are particularly suited.

The charge control agent which can be used in the toner is selected arbitrarily. Useful charge control agents for positively chargeable toners include nigrosine dyes and quaternary ammonium salts, and those for negatively chargeable toners include metallized monoazo dyes.

Any well-known dyes and/or pigments are useful as a colorant. Examples of suitable colorants are carbon black, Phthalocyanine Blue, Permanent Red, Chrome Yellow, and Phthalocyanine Green. The colorant is usually used in an amount of about 0.5 to 10 parts by weight per 100 parts by weight of the binder resin. External additives, such as fine silica powder and titania, can be added to the toner particles for improvement on fluidity and anti-agglomeration.

The method for preparing the toner is not particularly restricted. For example, a binder resin, a charge control agent and a colorant are dry blended thoroughly in a mixing machine, e.g., a HENSCHEL mixer, and the blend is melt-kneaded in, e.g., a twin-screw extruder. After cooling, the mixture is ground, classified, and mixed with necessary external additives in a mixing machine, etc.

The present invention will now be illustrated in greater detail with reference to Examples. Unless otherwise noted, all the percents and parts are by weight.

EXAMPLE 1

Mn—Mg—Sr ferrite powder having an average particle size of 80 μm, comprising 40 mol% of MnO, 10 mol% of MgO, and 50 mol% of $Fe_2O_3$, and having added thereto 0.8% of SrO as an external additive was used as a carrier core.

Equal weights of conducting agent A1 (particle size: 0.04 μm; spherical $TiO_2$ particles having a 30 A thick coating layer of $SnO_2$ having solid dissolved therein 10% of Sb based on $SnO_2$) and conducting agent B1 (particle size: 0.25 μm; spherical $TiO_2$ having a 30 A thick coating layer of $SnO_2$ having solid dissolved therein 10% of Sb based on $SnO_2$) were mixed. The A1/B1 mixed powder had a shape-surface index of 3.39.

A silicone resin (SR-2411) was mixed with 20.0% of the A1/B1 mixed powder (10% of A1 and 10% of B1), 10% of γ-aminopropyltriethoxysilane, each based on the resin solid content, and a solvent and thoroughly dispersed in a dispersing machine to prepare a resin solution.

A hundred parts of the carrier core was coated with 1.0 part, in terms of the silicone resin, of the resulting resin solution in a fluidized bed coating apparatus and baked at 250° C. for 2 hours. The resin-coated particles were sieved to remove greater particles than 100 mesh and further screened according to the magnetism to obtain a resin-coated carrier. The electric current measured according to the following method was 1.1 μA.

The resin-coated carrier was mixed with a magenta toner for full color development to prepare a developer having a toner concentration of 4%. The developer was tested on a digital copier AR-5130 (Sharp Corp.; modified). The copies obtained in the initial stage and after making 100,000 copies were observed with the naked eye to evaluate the image quality in terms of image density, fog, edge effect, and color mixing and rated as follows. Further, the electric current of the carrier and the charge quantity of the developer were measured as follows in the initial stage and after making 100,000 copies, and their rates of change were obtained. The results are shown in Table 3 below.

1) Current

The carrier was set on a magnetic brush. The magnetic brush was operated with an aluminum tube as an opposite electrode. The current under an applied voltage of 200 V was read.

2) Charge quantity

The toner and the carrier (toner concentration: 4%) were mixed at 200 rpm for 30 minutes. The charge quantity of the developer was measured with a suction type charge measuring instrument manufactured by Sankyo Piotec by using a 400 mesh steel net.

3) Image quality (visual observation)

The image density (solid image) was rated AA (very good), A (good), B (medium) or C (bad). Freedom of fog (background stains) was rated AA (very good), A (good), B (medium) or C (bad). Freedom from an edge effect and/or color mixing was rated AA (very good), A (good), B (medium) or C (bad).

EXAMPLE 2

A carrier and a developer were prepared in the same manner as in Example 1, except for using conducting agents A2 and B2 shown in Table 1 and γ-aminopropyltriethoxysilane each in an amount of 10% based on the solid resin content (SR-2411). Evaluation and measurement were made in the same manner as in Example 1. The results obtained are shown in Table 3.

EXAMPLE 3

A carrier and a developer were prepared in the same manner as in Example 1, except for replacing the silicone resin with an acryl-modified silicone resin (KR-9706) and using conducting agents A3 and B3 shown in Table 1 and γ-aminopropyltriethoxysilane in amounts of 12.5%, 37.5%, and 5.0%, respectively, based on the solid resin content. Evaluation and measurement were made in the same manner as in Example 1. The results obtained are shown in Table 3.

EXAMPLE 4

A carrier and a developer were prepared in the same manner as in Example 1, except for using conducting agents A2 and B2 and γ-aminopropyltriethoxysilane in amounts of 2.0%, 2.0%, and 10%, respectively, based on the solid resin content (SR-2411). Evaluation and measurement were made in the same manner as in Example 1. The results obtained are shown in Table 3.

EXAMPLE 5

A carrier and a developer were prepared in the same manner as in Example 1, except for using conducting agents A3 and B3 in amounts of 1.25% and 3.75%, respectively, based on the solid resin content (SR-2411) and adding no aminosilane coupling agent. Evaluation and measurement were made in the same manner as in Example 1. The results obtained are shown in Table 3.

EXAMPLE 6

A carrier and a developer were prepared in the same manner as in Example 1, except for using conducting agents A3 and B3 and γ-aminopropyltriethoxysilane in amounts of 0.25%, 4.75%, and 10%, respectively, based on the solid resin content (SR-2411). Evaluation and measurement were made in the same manner as in Example 1. The results obtained are shown in Table 3.

COMPARATIVE EXAMPLE 1

A carrier and a developer were prepared in the same manner as in Example 1, except for using conducting agents A4 and B4 shown in Table 1 and γ-aminopropyltriethoxysilane each in an amount of 10% based on the solid resin content (SR-2411). Evaluation and measurement were made in the same manner as in Example 1. The results obtained are shown in Table 3.

COMPARATIVE EXAMPLE 2

A carrier and a developer were prepared in the same manner as in Example 1, except for using an acryl-modified silicone resin (KR-9706) and conducting agent Cl shown in Table 1 in an amount of 30.0% based on the solid resin content and adding no aminosilane coupling agent. Evaluation and measurement were made in the same manner as in Example 1. The results obtained are shown in Table 3.

COMPARATIVE EXAMPLE 3

A carrier and a developer were prepared in the same manner as in Example 1, except for using conducting agents D1 and E1 shown in Table 1 and γ-aminopropyltriethoxysilane in amounts of 10.0%, 10.0%, and 5.0%, respectively, based on the solid resin content (SR-2411). Evaluation and measurement were made in the same manner as in Example 1. The results obtained are shown in Table 3.

COMPARATIVE EXAMPLE 4

A carrier and a developer were prepared in the same manner as in Example 1, except for using conducting agent D2 shown in Table 1 and γ-aminopropyltriethoxysilane in amounts of 60.0% and 5.0%, respectively, based on the solid resin content (SR-2411). Evaluation and measurement were made in the same manner as in Example 1. The results obtained are shown in Table 3.

COMPARATIVE EXAMPLE 5

A carrier and a developer were prepared in the same manner as in Example 1, except for using an acryl-modified silicone resin (KR-9706) and conductive carbon black (KETJEN BLACK EC-600JD) as a conducting agent and γ-aminopropyltriethoxysilane each in an amount of 5.0% based on the solid resin content. Evaluation and measurement were made in the same manner as in Example 1. The results obtained are shown in Table 3.

TABLE 1

| | | Conducting Agent | Core | Shape | Conducting Coating Layer ($SnO_2$) Additive to $SnO_2$ | Additive/$SnO_2$ (wt %) | Thickness (Å) | Particle Size (μm) | Shape-Surface Index | Mixing Ratio of Conducting Agent |
|---|---|---|---|---|---|---|---|---|---|---|
| Example No. | 1 | A1 | $TiO_2$ | spherical | Sb | 10 | 30 | 0.04 | 3.39 | 50 |
| | | B1 | $TiO_2$ | spherical | Sb | 10 | 30 | 0.25 | | 50 |
| | 2 | A2 | $TiO_2$ | spherical | Sb | 15 | 40 | 0.08 | 2.24 | 50 |
| | | B2 | $TiO_2$ | spherical | Sb | 10 | 40 | 0.50 | | 50 |
| | 3 | A3 | $TiO_2$ | lumpy | P | 5 | 10 | 0.01 | 5.29 | 25 |
| | | B3 | $TiO_2$ | lumpy | P | 5 | 10 | 0.10 | | 75 |
| | 4 | A2 | $TiO_2$ | lumpy | Sb | 15 | 40 | 0.08 | 2.24 | 50 |
| | | B2 | $TiO_2$ | lumpy | Sb | 10 | 40 | 0.50 | | 50 |
| | 5 | A3 | $TiO_2$ | lumpy | P | 5 | 10 | 0.01 | 5.29 | 25 |
| | | B3 | $TiO_2$ | lumpy | P | 5 | 10 | 0.10 | | 75 |
| | 6 | A3 | $TiO_2$ | lumpy | P | 5 | 10 | 0.01 | 4.76 | 5 |
| | | B3 | $TiO_2$ | lumpy | P | 5 | 10 | 0.10 | | 95 |
| Compara. Example No. | 1 | A4 | $TiO_2$ | spherical | Sb | 10 | 3 | 0.05 | 3.21 | 50 |
| | | B4 | $TiO_2$ | spherical | Sb | 10 | 30 | 0.30 | | 50 |
| | 2 | C1 | $TiO_2$ | needle-like | Sb | 10 | 25 | breadth: 0.15 length: 2.0 | 1.12 | — |
| | 3 | D1 | $TiO_2$ | lumpy | none | — | 10 | 0.01 | 8.26 | 50 |
| | | E1 | $TiO_2$ | lumpy | none | — | 10 | 0.04 | | 50 |
| | 4 | D2 | $TiO_2$ | lumpy | none | — | 10 | 0.10 | 1.94 | — |
| | 5 | F1 | carbon black (KETJEN BLACK EC-600JD) | | | | | | | — |

TABLE 2

| Composition of Coating Resin | | Coating Resin | Amount of Conducting Agent (wt %) | Coupling Agent Kind | Coupling Agent Amount (wt %) |
|---|---|---|---|---|---|
| Example No. | 1 | silicone resin SR-2411 | 20 | γ-aminopropyl-ethoxysilane | 10 |
| | 2 | silicone resin SR-2411 | 20 | γ-aminopropyl-ethoxysilane | 10 |
| | 3 | acryl-modified silicone resin KR-9706 | 50 | γ-aminopropyl-ethoxysilane | 5 |
| | 4 | silicone resin SR-2411 | 4 | γ-aminopropyl-ethoxysilane | 10 |
| | 5 | silicone resin SR-2411 | 5 | not added | — |
| | 6 | silicone resin SR-2411 | 5 | γ-aminopropyl-ethoxysilane | 10 |
| Compara. Example No. | 1 | silicone resin SR-2411 | 20 | γ-aminopropyl-ethoxysilane | 10 |
| | 2 | acryl-modified silicone resin KR-9706 | 30 | not added | — |
| | 3 | silicone resin SR-2411 | 20 | γ-aminopropyl-ethoxysilane | 5 |
| | 4 | silicone resin SR-2411 | 50 | γ-aminopropyl-ethoxysilane | 5 |
| | 5 | acryl-modified silicone resin KR-9706 | 5 | γ-aminopropyl-ethoxysilane | 5 |

Note:
SR-2411: product of Toray Dow Corning Silicone
KR-9706: product of Shin-Etsu Chemical

TABLE 3

| | | Current | Initial Image Quality | | | | Image Quality After Making 100,000 Copies | | | | |
|---|---|---|---|---|---|---|---|---|---|---|---|
| | | of Carrier ($\mu$A) | Density | Fog | Edge* | Charge Quantity | Density | Fog | Edge* | Rate of Change in Current (%) | Rate of Change in Charge (%) |
| Example | 1 | 1.1 | AA | AA | AA | −14.1 | AA | AA | AA | 94 | 95 |
| No. | 2 | 0.75 | A | A | AA | −14.6 | AA | A | AA | 85 | 88 |
| | 3 | 0.8 | A | A | A | −14.5 | A | A | A | 88 | 86 |
| | 4 | 0.5 | B | A | B | −12.6 | B | A | B | 80 | 84 |
| | 5 | 0.6 | B | A | B | −15.9 | B | A | B | 84 | 80 |
| | 6 | 0.5 | B | A | B | −14.2 | B | B | B | 75 | 83 |
| Compara. | 1 | 0.3 | C | C | C | −14.7 | C | C | C | 65 | 74 |
| Example | 2 | 0.08 | C | C | C | −14.6 | C | C | C | 50 | 65 |
| No. | 3 | 0.2 | C | A | C | −14.3 | C | C | C | 60 | 70 |
| | 4 | 0.1 | C | B | C | −15.1 | C | B | C | 53 | 70 |
| | 5 | 2.1 | AA | C | C | −11.3 | AA | C | C | 92 | 80 |

Note: *Freedom from edge effect and color mixing

As is shown in Table 3, Examples 1 to 6 exhibit desirable resistance and secure satisfactory image quality, whereas Comparative Examples 1 to 5 show scatter in carrier resistance and inferiority in image quality.

What is claimed is:

1. A carrier for an electrophotographic developer which is coated with an insulating resin containing a white conducting agent, wherein said white conducting agent comprises spherical to lumpy particles of $TiO_2$, $ZnO_2$ or $SnO_2$ having two or more average particle sizes, said particles having thereon a 5 to 50 Å thick conducting layer of $SnO_2$ having a group V metal or phosphorus in solid solution therein.

2. A carrier according to claim 1, wherein said white conducting agent comprises particles having two average particle sizes, the smaller particles having an average particle size of from 0.01 to 0.08 $\mu$m, the larger particles having an average particle size of from 0.1 to 0.5 $\mu$m, and the weight ratio of said smaller particles to said larger particles is from 10:90 to 90:10.

3. A carrier according to claim 1, wherein said white conducting agent has a shape-surface index of 2.0 to 6.0, and the content of said white conducting agent in said insulating resin is from 2 to 75 by weight, the shape-surface index being equal to a specific surface area determined by a BET method ($m^2/g$) divided by a specific surface area determined by an air permeation method ($m^2/g$).

4. A carrier according to claim 1, wherein said white conducting agent comprises spherical to lumpy $TiO_2$.

5. A carrier according to claim 1, wherein said insulating resin further contains an aminosilane coupling agent.

6. A carrier according to claim 1, wherein said insulating resin is a silicone resin or a modified silicone resin.

7. A carrier according to claim 6, wherein said silicone resin or modified silicone resin contains an aminosilane coupling agent.

8. An electrophotographic developer comprising a toner and the carrier according to claim 1.

* * * * *